US010815762B2

(12) United States Patent
Althoff

(10) Patent No.: US 10,815,762 B2
(45) Date of Patent: Oct. 27, 2020

(54) PROVIDING COMMUNICATION BETWEEN WELLBORES THROUGH DIRECTIONAL HYDRAULIC FRACTURING

(71) Applicant: Halliburton Energy Services, Inc., Houston, TX (US)

(72) Inventor: Gary D. Althoff, Houston, TX (US)

(73) Assignee: Halliburton Energy Services, Inc., Ausitn, TX (US)

( * ) Notice: Subject to any disclaimer, the term of this patent is extended or adjusted under 35 U.S.C. 154(b) by 198 days.

(21) Appl. No.: 15/558,508

(22) PCT Filed: May 14, 2015

(86) PCT No.: PCT/US2015/030881
§ 371 (c)(1),
(2) Date: Sep. 14, 2017

(87) PCT Pub. No.: WO2016/182581
PCT Pub. Date: Nov. 17, 2016

(65) Prior Publication Data

US 2018/0080309 A1 Mar. 22, 2018

(51) Int. Cl.

| | |
|---|---|
| ***E21B 43/17*** | (2006.01) |
| ***E21B 43/26*** | (2006.01) |
| ***E21B 43/30*** | (2006.01) |
| ***E21B 49/00*** | (2006.01) |
| ***E21B 43/116*** | (2006.01) |

(52) U.S. Cl.
CPC ..... *E21B 43/17* (2013.01); *E21B 43/116* (2013.01); *E21B 43/26* (2013.01); *E21B 43/305* (2013.01); *E21B 49/00* (2013.01)

(58) Field of Classification Search
CPC ..... E21B 43/116; E21B 43/17; E21B 43/26; E21B 43/305; E21B 49/00
See application file for complete search history.

(56) References Cited

U.S. PATENT DOCUMENTS 5,074,360 A 12/1991 Guinn
6,119,776 A * 9/2000 Graham ..... E21B 43/17 166/245

(Continued)

FOREIGN PATENT DOCUMENTS

EP 2518264 B1 4/2014

OTHER PUBLICATIONS

Canadian Application Serial No. 2,980,272; First Examiner's Letter; dated Jul. 9, 2018, 3 pages.

(Continued)

*Primary Examiner* — Caroline N Butcher
(74) *Attorney, Agent, or Firm* — Gilliam IP PLLC

(57) ABSTRACT

Collection of hydrocarbons in a collection region that is non-contiguous to a production well is described. A path between the production well and a collection well is determined, which is not necessarily the shortest distance path. A fluid communication channel is then provided within a geological formation between the production well and collection well, along the determined path. Fluid communication is provided between the production well and the collection well without intersecting the collection well with the production well, and without otherwise drilling a hole to connect the production well and collection well.

20 Claims, 5 Drawing Sheets

(56) References Cited

U.S. PATENT DOCUMENTS

| | | | | |
|---|---|---|---|---|
| 2013/0228372 | A1* | 9/2013 | Linyaev | E21B 7/15 175/16 |
| 2015/0008001 | A1 | 1/2015 | Hay et al. | |
| 2016/0003017 | A1* | 1/2016 | Keller | E21B 43/162 166/250.1 |
| 2016/0230526 | A1* | 8/2016 | Crews | E21B 43/17 |

OTHER PUBLICATIONS

Australian Application Serial No. 2015394579; First Examination Report; dated May 15, 2018, 3 Pages.
"International Application Serial No. PCT/US2015/030881, International Search Report dated Feb. 19, 2016", 3 pgs.
"International Application Serial No. PCT/US2015/030881, Written Opinion dated Feb/ 19, 2016", 8 pgs.

* cited by examiner

PROVIDING COMMUNICATION BETWEEN WELLBORES THROUGH DIRECTIONAL HYDRAULIC FRACTURING

BACKGROUND

Multiple, interlinked wells are commonly used in subterranean operations to maximize the production of hydrocarbon fluids from a subterranean formation. The use of multiple, interlinked wells may result in higher production than can be obtained from multiple, non-interlinked wells. There can be a great deal of uncertainty associated with the true three-dimensional location of wells, and therefore it can be difficult for operators to ensure that wells are actually interlinked.

DETAILED DESCRIPTION

Figure 1:
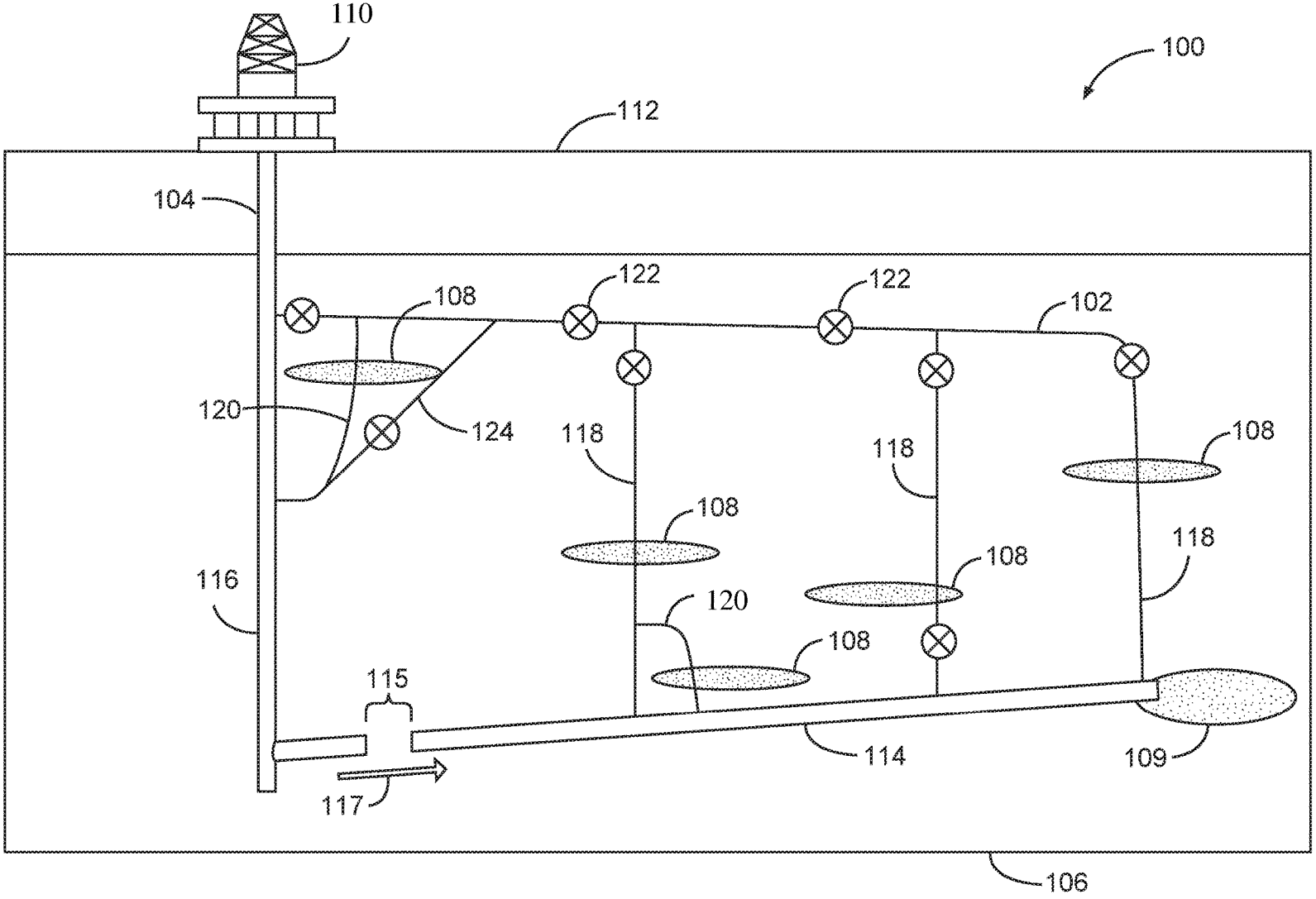
FIG. 1 is a schematic of a subsurface well system in which some example embodiments can be implemented.

To address some of the challenges described above, as well as others, apparatus, systems, and methods are described herein that operate to provide fluid communication between wellbores that do not already intersect.

Multiple, interlinked wells are commonly used in subterranean operations to maximize the production of hydrocarbon fluids from a subterranean formation. The use of multiple, interlinked wells may result in higher production than can be obtained from multiple, non-interlinked wells. Interlinked wells can be particularly advantageous in lenticular pay zones (also commonly referred to in the art as compartmentalized reservoirs), for example, where there can be multiple, non-contiguous hydrocarbon-bearing subterranean zones.

In example embodiments, a plurality of hydrocarbon-bearing subterranean zones (e.g., in a lenticular pay zone) can be efficiently produced by pooling the hydrocarbons contained therein into one or more collection regions that deliver the pooled hydrocarbons to a production well. As used herein, a collection region may be a wellbore segment that is either contiguous with the production well or comprises a separately drilled collection well. A collection region that is contiguous with a production well may comprise, for example, the substantially non-vertical heel to toe portion of a wellbore that is drilled from a production well extending from the earth's surface. Several embodiments described herein include a collection well comprising a separately drilled collection region. However, it is to be recognized that any described embodiment having a separately drilled collection well can be practiced similarly using a wellbore having a collection region that is contiguous with the production well.

Multiple drain wells emanating from the production well can be used to deliver the hydrocarbons to the collection region. In some embodiments, the drain wells can intersect or otherwise be in fluid communication with the collection region. A fluid can refer to a substance in a gas state as well as in a liquid state. In some or other embodiments, the drain wells can re-intersect or otherwise be in fluid communication with the production well. Fluid communication may include a condition in which a fluid can flow from a first well to a second well intersecting the two wells or drilling between the two wells. For example, a drain well spaced from a collection region or production well can be in fluid communication with the collection region or production well if a fluid in the drain well can travel to the collection region or production well via natural or artificially introduced permeability/porosity within the subterranean formation, such as fractures. In some embodiments, fluid communication can be established between two wells by drilling the wells suitably close to one another (but still without intersecting the two wells) and then perforating the geological formation between them with a perforation gun disposed in at least one of the two wells. Unless otherwise specified herein, use of the terms "intersect," "intersection," and grammatical equivalents thereof will be understood to represent both a physical connection and/or a fluid communication between two wells. The pooling of a hydrocarbon fluid from multiple drain wells into a single production well can enable a single fluid lift mechanism to be utilized in the production well, which can be more efficient and less costly than operating a fluid lift mechanism in multiple wells.

FIG. 1 is a schematic of a subsurface well system 100 in which some example embodiments can be implemented. The subsurface well system 100 has a branched drain well 102 extending laterally from the production well 104. As shown in FIG. 1, the subsurface well system 100 is located within a lenticular pay zone 106 having one or more hydrocarbon-bearing subterranean zones 108 located therein. Wellhead 110 is located on earth's surface 112, where earth's surface 112 can be the earth's crust, water, ice and the like. Subsurface well system 100 contains collection well 114. Due to inaccuracies and uncertainties in 3D positioning, the collection well 114 can be communicatively isolated from the production well 104. Embodiments will ensure or help ensure that the collection well 114 is in fluid communication with the production well 104. The production well 104 and collection well 114 can be cased or open, in various embodiments.

Although FIG. 1 has depicted only a single collection well 114, it is to be recognized that any number of collection wells can be present, if desired. Further, in some embodiments, the collection well 114 can comprise a collection region that is contiguous with production well 104, as noted previously. Embodiments can help collection well 114 intersect production well 104 at any desired location along the axial length of production well 104. In some embodiments, collection well 114 can be made to intersect production well 104 at the lowermost point of the production well 104. In some embodiments, collection well 114 can be made to intersect production well 104 above its lowermost point, thereby creating sump 116 in which hydrocarbons can pool and subsequently be produced to the earth's surface thereby using artificial lift methods for well production. When multiple collection wells are present, they need not intersect production well 104 at substantially the same point. Embodiments can be applied to natural reservoir-driven production and to artificial lift methods.

In some embodiments, at least one branched drain well 102 can extend laterally from production well 104. Although FIG. 1 has shown only one branched drain well 102 extending from production well 104, it is to be recognized that any number of branched drain wells can be present. Furthermore, any number of branches can be present, in or otherwise extend from branched drain well 102. In some embodiments, at least some of the branches can intersect collection well 114, or a collection region, if present. As depicted in FIG. 1, branches 118 can intersect with collection well 114. In some embodiments, at least some of the branches can intersect production well 104.

As depicted in FIG. 1, branch 120 can intersect production well 104 above a point where collection well 114 intersects or is in fluid communication with production well 104. That is, branch 120 can intersect production well 104 at a point above the fluid connection of the collection region to the production well 104. Any number of branches 118 can intersect collection well 114, and any number of branches 120 can intersect production well 104. Furthermore, in some embodiments, the branches can themselves be further branched (e.g., branch 120) or intersect with other branches (e.g., branch 124). Although FIG. 1 has depicted only 5 branches extending directly from branched drain well 102, it is to be recognized that any number of branches can be present depending, at least in part, on the number of hydrocarbon-bearing subterranean zones 108 that need to be drained.

In some embodiments, the collection region can be located below the hydrocarbon-bearing subterranean zones through which the drain wells extend. Such an embodiment is depicted in FIG. 1. In alternative embodiments, the collection region can be located above at least some of the hydrocarbon-bearing subterranean zones, if desired.

In some of the embodiments described herein, the collection region can intersect at least one hydrocarbon-bearing subterranean zone. Although FIG. 1 has depicted collection well 114 intersecting hydrocarbon-bearing subterranean zone 109, it is to be recognized that the intersecting feature is optional. Whether the collection region intersects a hydrocarbon-bearing subterranean zone will depend upon operational considerations that will be evident to one having ordinary skill in the art. Subsurface well systems described hereinabove can further comprise one or more valves 122 or other like means to control fluid flow or otherwise isolate certain portions of the system.

Re-intersecting a drain well 102 with the production well 104 after draining a hydrocarbon-bearing subterranean zone can allow the hydrocarbon fluid to be transported directly to the production well 104 without having to be returned via the collection region. Furthermore, re-intersecting a drain well 102 with the production well 104 may allow for an overall shorter well length than if the drain well 102 is extended all the way to the collection region. However, depending on the depth and location of the wells, there can be a great deal of uncertainty associated with the wells' three-dimensional (3D) location, leading to the wellbores not actually intersecting. For example, the collection well 114 may not actually intersect with the production well 104.

Embodiments account for the positional uncertainties, and increase the likelihood that wellbores (e.g., the collection well 114 and the production well 104, or the production well 104 and drain wells 120, 102, etc.) will actually intersect, by fracturing a portion of rock to improve fluid communication between wellbores. Some embodiments use formation evaluation measurements, for example sonic measurements and density measurements (although embodiments are not limited thereto) to find a fracture path 117 between wellbores. In other embodiments, the fracture path 117 can be determined based on a spatial or directional relationship between the production well 104 and the collection well 114. The fracture path 117 may not necessarily be the shortest possible path, but rather the fracture path 117 may be determined based on the ease with which intervening rock is expected to fracture, based on the formation evaluation measurements. Embodiments can also use azimuthal formation evaluation logs to determine the preferential direction of the fracture. These azimuthal formation evaluation logs can include values for indicating sonic properties, density properties, or any other properties commonly used for evaluating rocks or formations. Embodiments are not limited to fracturing, however, and can alternatively or additionally make use of mechanical means (i.e. perforation guns) to create fluid communication channels between wellbores.

Figure 2:
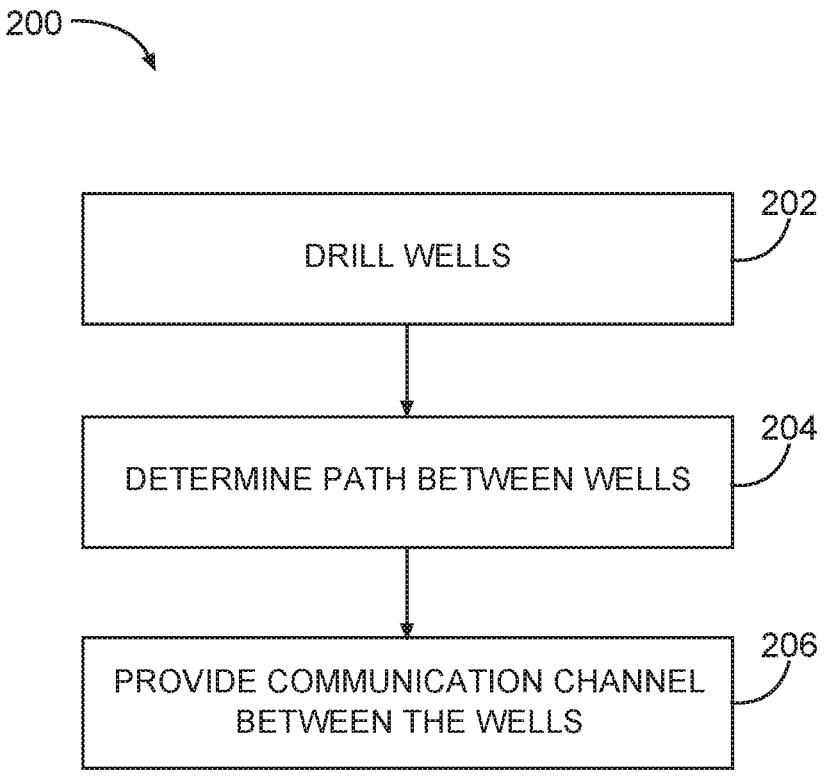
FIG. 2 is a flow diagram illustrating an example method for drilling a subsurface well system, in accordance with some embodiments.

FIG. 2 is a flow diagram illustrating an example method 200 for drilling a subsurface well system, in which further assurance is provided that desired wells will intersect, in accordance with some embodiments. Some operations of the example method 200 can be performed by a processing unit 302 (FIG. 3) or any other component of FIG. 3, by way of nonlimiting example.

The example method 200 begins with operation 202 by drilling a production well 104 (FIG. 1) extending from the earth's surface 112 (FIG. 1), and then drilling a collection well 114 (FIG. 1) to collect hydrocarbons from a collection region that is non-contiguous to the production well 104. The example method 200 continues at operation 204 by the processing unit 302 determining a path 117 (FIG. 1) along a geological formation between the collection well 114 and production well 104.

The example method 200 continues at operation 206 with providing a fluid communication channel along the path 117, for fluid communication between the production well 104 and the collection well 114.

In some embodiments, the path 117 can be determined when the processing unit 302 (FIG. 3) or measuring device 312 (FIG. 3) measures at least one property associated with a geological formation between the production well 104 and the collection well 114. In some embodiments determining the path 117 includes determining, based on the measured property, a path 117 in a formation between the production well 104 and the collection well 114 that is predicted to fracture. Such a prediction can be generated based on measurements of formation properties, for example, formation stresses, moduli of elasticity and plasticity of the formation, cracking resistance, permeability, etc. The path 117 may or may not be the shortest distance path between the production well 104 and the second wellbore.

The formation measurements can be provided by, for example, analysis of formation evaluation logs which can be accessed from memory in a surface system or any other memory or storage system. In some examples, the formation evaluation logs may be azimuthal although embodiments are not limited thereto. As an example, formation stresses can be calculated using azimuthal sonic data. In some examples, the processing unit 302 can use a bulk measurement such as spectral gamma measurements to obtain a view or representation of a view along the wellbore of where rocks can be predicted to fracture better. In further example embodiments, a physical property of rock, for example total organic content (TOC), can be used alone or in conjunction with spectral gamma measurements. TOC may be generated based on a combination of several other measurements taken by devices or components illustrated in FIG. 3 or FIG. 6.

In other embodiments, the path 117 is determined based on a relative physical position of the production well 104 to the collection well 114, or on wellbore positioning calculations, which include ellipses of uncertainty.

In some embodiments, providing the fluid communication channel includes generating a fracture between the production well 104 and the collection well 114. The fracture can be initiated with perforation charges by, for example, a perforation gun (FIG. 3) in some embodiments, or the fracture can be initiated using common fracturing methods described later herein.

Figures 4, 5:
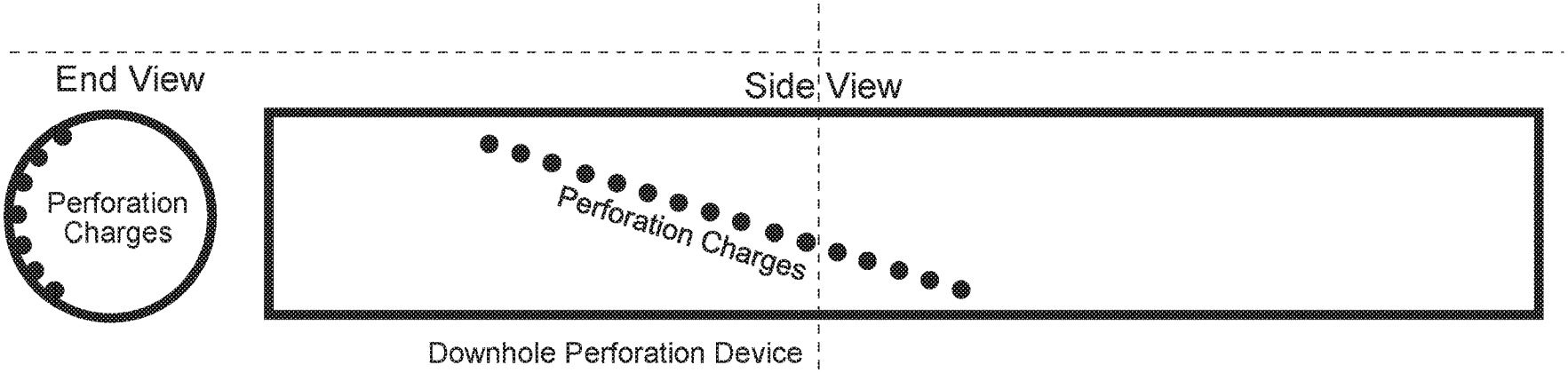
FIG. 4 is an end view of a perforation gun with a pattern distribution of perforation charges in accordance with some embodiments.
FIG. 5 is a side view of a perforation gun with a pattern distribution of perforation charges in accordance with some embodiments.

In some embodiments, providing the fluid communication channel includes performing a perforation of the formation between the production well 104 and the collection well 114. In other embodiments, at least an initial phase of a fracture can be performed by perforation, wherein a preferential direction for the fracture is indicated upon performing the perforation. At least some embodiments include performing the perforation by adjusting a spread of perforations by aligning perforation guns in a pattern distribution over a circumference of the production well 104. FIG. 4 is an end view of a perforation gun with a pattern distribution of perforation charges in accordance with some embodiments. FIG. 5 is a side view of a perforation gun with a pattern distribution of perforation charges in accordance with some embodiments.

Referring again to FIG. 2, in some embodiments, the method 200 includes monitoring a property at the collection well 114, using available well monitoring systems at the collection well 114, to determine whether fluid communication exists between the production well 104 and the collection well 114, and to determine when the fracturing or other path-generating procedures are to be terminated. For example, in some embodiments, the method 200 can include monitoring wellbore pressure at the collection well 114.

It will be appreciated that some example embodiments can provide a network of focus fractures for providing intersections between multiple wells, for example in a point-to-multipoint configuration between one wellbore and several other wells, or between a group of wellbores and another group of wellbores, or between a group of wellbores and one other wellbore, by way of nonlimiting example. For example, fracturing can allow multiple drain wells 102 to intersect with a production well 104, or with a collection well 114. Other embodiments can use a slotted liner or any other completion technique.

As mentioned earlier herein, in some embodiments, a perforation gun can be used instead of fracturing, or to begin a fracturing process along a fracturing path. For example, if hydrocarbon-bearing subterranean zones are within a few feet (for example less than 5 feet) of each other, as determined by geographical information known to the operator or as determined by azimuthal formation evaluation logs, embodiments can perforate between the two wellbores until fluid communication is achieved between the production well 104 and the collection well 114. Otherwise, in other embodiments, fracturing can be performed between wellbores further apart, for example between 30 and 50 feet apart, or further.

Embodiments can also make use of other techniques for reducing or eliminating the level of uncertainty in the 3D position of the production well 104 and the collection well 114 or any other wells. For example, in some embodiments, magnetic ranging can be used to reduce or eliminate 3D space uncertainties created by typical directional surveys and their associated ellipse of uncertainty. Magnetic ranging technology is typically a very low frequency system and allow only for "side looking." In at least these embodiments, two wellbores are drilled relative to each other and the distance between them can be determined by inducing a magnetic field on one of the casings for one of the two wellbores.

In some other embodiments, look ahead/look around (LA/LA) (or wellbore intersection and avoidance) electromagnetic surveying can reduce or eliminate 3D space uncertainties. Although LA/LA is often used in available systems to identify formational responses (for example, to identify formation resistivity and anisotropy), embodiments can also use LA/LA for locational purposes. Wellbore intersection is most commonly used during blowout well control.

Figure 3:
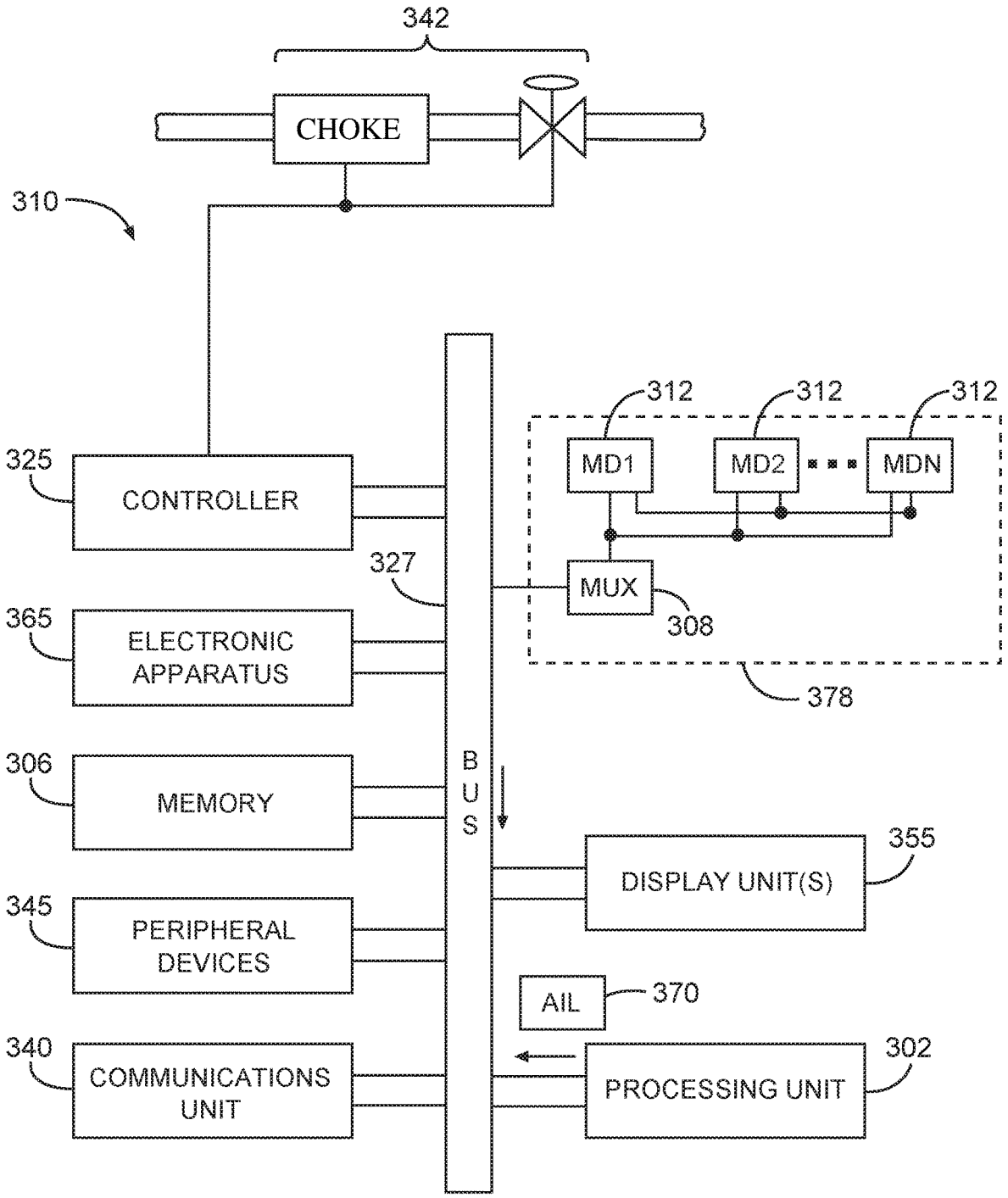
FIG. 3 illustrates apparatus and a control system according to various embodiments.

FIG. 3 illustrates a control system 310 according to various embodiments of the invention. The control system 310 is operable within a wellbore, or in conjunction with wireline and drilling operations, as will be discussed later.

In many embodiments, the control system 310 can receive measurements for properties associated with a fracture in a geological formation between the production well 104 (FIG. 1) and the collection well 114 (FIG. 1) via one or more external measurement devices 312. The measurement devices 312 can also provide environmental measurement data (e.g., a fluid parameter measurement device to measure temperature, pressure, flow velocity, and/or volume, etc.). In some embodiments, a multiplexer 308 can multiplex measurements of the various measurement devices 312 and provide the multiplexed measurements to the processing unit 302. Other peripheral devices and sensors 345 may also contribute information to assist in the identification and measurement of fractures, proppant flow, proppant concentration, and the simulation of various values that contribute to system operation.

The processing unit 302 can use property measurements to determine a path 117 (FIG. 1) between the production well 104 and the collection well 114 based on the property measurement, or based on a spatial relationship between the production well 104 and the collection well 114, among other functions, when executing instructions that carry out the methods described herein. These instructions may be stored in a memory, such as the memory 306. These instructions can transform a general purpose processor into the specific processing unit 302 that can then be used to generate a control signal to a controlled device (e.g. choke and/or valve) 342 directly, via the bus 327, or indirectly, via the controller 325. In either case, commands are delivered to the controlled device 342 to cause the controlled device 342 to provide a fluid communication channel within the geological formation, along the path 117 and based on the measured property, for fluid communication between the production well 104 and the collection well 114.

As will be described in more detail below, in some embodiments, a housing 378, such as a wireline tool body, or a downhole tool, can be used to house one or more components of the control system 310 as described in more detail below with reference to FIG. 6. The processing unit 302 may be part of a surface workstation or attached to a downhole tool housing such as the housing 378.

The control system 310 can include other electronic apparatus 365 (e.g., electrical and electromechanical valves and other types of actuators), and an electronics communications unit 340, perhaps comprising a telemetry receiver, transmitter, or transceiver. The controller 325 and the processing unit 302 can each be fabricated to operate the measurement device(s) 312 to acquire measurement data, including but not limited to measurements representing any of the physical parameters described herein. Thus, in some embodiments, such measurements are made within the physical world, and in others, such measurements are simulated. In many embodiments, physical parameter values are provided as a mixture of simulated values and measured values, taken from the real-world environment. The measurement devices 312 may be disposed directly within a formation, or attached to another apparatus (e.g., a drill string, sonde, conduit, housing, or a container of some type) to sample formation and fluid flow characteristics.

The bus 327 that may form part of a control system 310 can be used to provide common electrical signal paths between any of the components shown in FIG. 3. The bus 327 can include an address bus, a data bus, and a control bus, each independently configured. The bus 327 can also use common conductive lines for providing one or more of address, data, or control, the use of which can be regulated by the processing unit 302, and/or the controller 325.

The bus 327 can include circuitry forming part of an electronic communication network. The bus 327 can be configured such that the components of the control system 310 are distributed. Such distribution can be arranged between downhole components and components that can be disposed on the surface of the Earth. Alternatively, several of these components can be co-located, such as in or on one or more collars of a drill string or as part of a wireline structure.

In various embodiments, the control system 310 includes peripheral devices, such as one or more displays 355, additional storage memory, or other devices that may operate in conjunction with the controller 325 or the processing unit 302.

Displays 355 can be used to display diagnostic information, measurement information, model and function information, control system commands, as well as combinations of these, based on the signals generated and received, according to various method embodiments described herein. The displays 355 may be used to track the values of one or more measured flow parameters, simulated flow parameters, and fracture parameters to initiate an alarm or a signal that results in activating functions performed by the controller 325 and/or the controlled device 342. The display 355 can display data related to the path 117, determined by the processing unit 302 in accordance with embodiments described herein, between the production well 104 and the collection well 114. For example, the display 355 can display the path 117 and the fracturing progress of the path 117 or other fractures.

In an embodiment, the controller 325 can be fabricated to include one or more processors. The display 355 can be fabricated or programmed to operate with instructions stored in the processing unit 302 (and/or in the memory 306) to implement a user interface to manage the operation of components distributed within the control system 310. This type of user interface can be receive inputs from the processing unit 302, measurement devices 312, or other elements over the bus 327.

Various components of the control system 310 can be integrated with other apparatuses or associated housing 378 such that processing identical to or similar to the methods discussed with respect to various embodiments herein can be performed downhole.

In various embodiments, a non-transitory machine-readable storage device can comprise instructions stored thereon, which, when performed by a machine, cause the machine to become a customized, particular machine that performs operations comprising one or more features similar to or identical to those described with respect to the methods and techniques described herein. A machine-readable storage device is a physical device that stores information (e.g., instructions, data), which when stored, alters the physical structure of the device. Examples of machine-readable storage devices can include, but are not limited to, memory 306 in the form of read only memory (ROM), random access memory (RAM), a magnetic disk storage device, an optical storage device, a flash memory, and other electronic, magnetic, or optical memory devices, including combinations thereof.

The physical structure of stored instructions may be operated on by one or more processors such as, for example, the processing unit 302. Operating on these physical structures can cause the machine to perform operations according to methods described herein. The instructions can include instructions to cause the processing unit 302 to store associated data or other data in the memory 306. The memory 306 can store the results of measurements of fluid, formations, fractures, and other parameters. The memory 306 can store a log of measurements that have been made. For example, the memory 306 can store azimuthal formation evaluation logs, for access by the processing unit 302 to determine the path 117 between the production well 104 and the collection well 114 as described earlier herein. The memory 306 therefore may include a database, for example a relational database. Thus, still further embodiments may be realized.

Upon reading and comprehending the content of this disclosure, one of ordinary skill in the art will understand the manner in which a software program can be launched from a computer-readable medium in a computer-based system to execute the functions defined in the software program. One of ordinary skill in the art will further understand the various programming languages that may be employed to create one or more software programs designed to implement and perform the methods disclosed herein. For example, the programs may be structured in an object-orientated format using an object-oriented language such as Java or C#. In another example, the programs can be structured in a procedure-orientated format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

Figure 6:
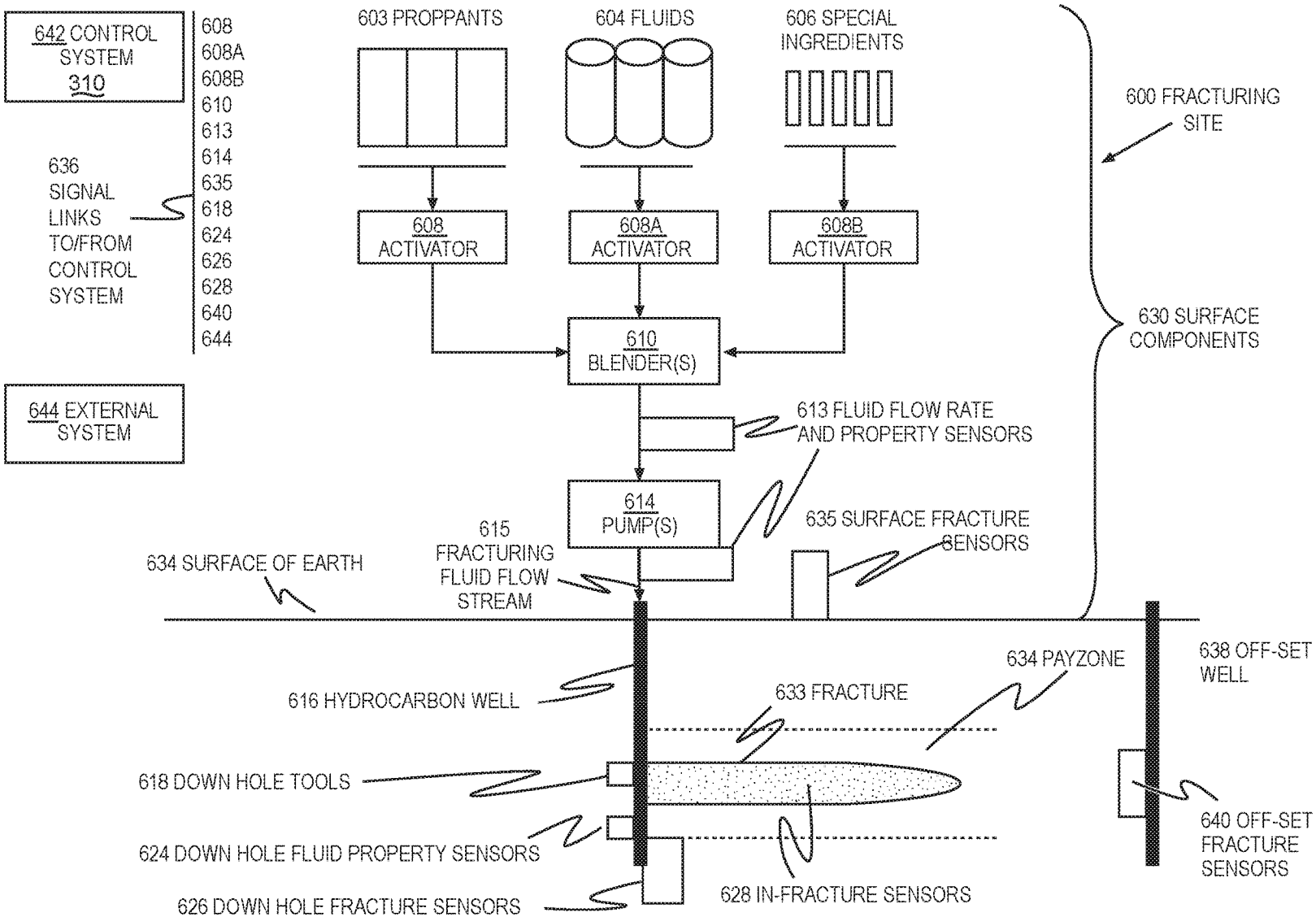
FIG. 6 depicts a fracturing site including a fracturing system configured to deliver proppants, fluids, gases, liquids, special ingredients, and compositions of these to subterranean formations in accordance with various embodiments.

FIG. 6 depicts a fracturing site 600 including a fracturing system configured to deliver proppants, fluids (including liquid or gas), special ingredients, and compositions of these to subterranean formations in accordance with various embodiments. Fracturing can be done in various embodiments using any sort of materials such as any liquid, gas or other substance. Site 600 can be located on land or on or in a water environment. For simplicity, the following discussion will refer to a land-based site, although various embodiments are not to be limited thereto.

The site 600 can contain one or more proppant stores 603 which contain one or more different proppant types or grades as would be known to one of ordinary skill in the art of proppant specification and design. The site can contain one or more fluid stores 604 for water, gas (e.g., carbon dioxide ($CO_2$)), solvents, non-aqueous fluids, pad fluids, pre-pad-fluids, viscous fluids for suspending proppants, and liquid components to formulate fracturing fluids as would be known to open skilled in the art of fracturing fluid specification and design. The site can contain one or more special solid or liquid ingredient stores 606 which have specialized functions in the fracturing and propping processes.

The flow actuation and control of proppant stores 603, fluid stores 604, and special ingredients stores 606 can be controlled by activators 608, 608A, and 608B, respectively. One or more blenders 610 can receive the proppants from the proppant stores 603, the fluids from the fluid stores 604, and special ingredients from special ingredients stores 606 to prepare fracturing and propping fluids in various proportions. One or more pumps 614 can pump the resulting fracturing and propping fluids down-hole into hydrocarbon well 616 beneath the surface of the earth 634.

Components 603, 604, 606, 608, 608A, 608B, 610, 613, 614, 635, and 642 comprise surface components 630. Sensors 613 can monitor the fracturing and propping fluid flow rates, as well as the properties of the fluids or gases, at positions either before or after the pumps 614, or at both locations. Downhole tools 618 can act directly on the fracturing and propping fluids or gases to control the values of the properties of the fluids as the fluids create and enter fracture 633, which is shown, for simplicity of illustration, in one direction from well 616.

Downhole fluid property sensors 624 can measure the fluid property (or gas property for $CO_2$ fracking) values as the fluids (or gases) enter fracture 633. In-fracture fluid sensors 628 can sense the fluid property values of the fluid inside the fracture. Downhole fracture sensors 626 can sense the dimensions of fracture 633 from a downhole location. Off-set fracture sensors 640 can sense the dimensions of fracture 633 from an offset location downhole in a different well 638. Surface fracture sensors 635 can sense the dimensions of fracture 633 from the surface of the Earth.

The control system 642, which may comprise any one or more elements of the control system 310 of FIG. 3, can be linked via signal links 636 to the listed components. The control system 642 can also be linked to an external system 644 which in some embodiments can be an external data collection or supervisory control system. The control system 642 can implement the method described earlier herein with reference to FIG. 2. The control system 642 can thus provide a fluid communication channel within the geological formation, along a path 117 based on the measured formation properties, for fluid communication between the production well 104 and the collection well 114 consistent with this disclosure.

Turning now to FIGS. 1-6, it can be seen that the method 200 of FIG. 2, as well as the control system 310 of FIG. 3, can thus be employed to conduct fracturing on a site such as fracturing site 600 to provide fluid communication channels between wells within a geological formation along a determined path 117 or paths, based on measured properties within the geological formation.

To form a control system according to some embodiments described herein, the control system can use property measurements provided with measurement devices and other sensors to determine a path between a production well 104 and collection wells 114 or reservoirs and provide parameters for this path 117 to adjust fracturing activities performed by surface components 630, as well as for downhole tools 618. The control system 642 can then output signals to control the surface and downhole tools of the fracturing system, such as generally shown in the site 600.

Systems and apparatuses according to embodiments can not only be used to create an initial fracture plan or to initiate a fracture along an initial point of a path 117 through a formation, but to estimate the current state of the fracture during fracturing in real-time. This estimate can use fracture well sensors, such as downhole fracture sensors 626 and/or off-set sensors 640 and/or surface sensors 635. Thus, many embodiments may be realized.

For example, referring now to FIGS. 1-3 and FIG. 6, it can be seen that a control system 310 may comprise at least one measurement device (e.g., elements 312, 613, 624, 626, 628, 635, and/or 640) to measure at least one property associated with a fracture 633 in a geological formation (e.g., pay zone 634) as a measured property. The control system 310 may further include a processing unit (e.g., elements 302, 325, 642) to receive measured properties, calculate paths through the geological formation, and to implement a fracturing model that responsively generates an actuator input level 370 (e.g., via one or more of the signal links 636). In many embodiments, the control system 310 comprises a fracturing fluid injection valve (e.g., as part of a controlled device 342) coupled to the processing unit to operate in response to the actuator input level 370.

Some embodiments of the control system 310 may include a controller 325. Thus, the control system 310 may comprise a proportional-integral-derivative (PID) controller to couple the processing unit 302 to the valve, operating as a controlled device 342.

A variety of devices can be used to measure fracture properties. For example, the at least one measurement device 312 may comprise one or more of geophones, accelerometers, or tilt meters, as well as combinations of these.

In some embodiments, measurement devices can be attached to downhole logging tools. Thus, the control system 310 may comprise a housing 378, including a downhole logging tool attached to the at least one measurement device.

In some embodiments, the control system 310 may include a choke, which is put in line before or after the fracturing fluid valve—to effectively control the pumping rate. Thus, the control system 310 may comprise a fracturing fluid injection valve coupled to a choke (e.g., operating as a pair of controlled devices 342) to adjust pressure and flow rate of the fracturing fluid.

Many advantages can be gained by implementing the methods, apparatus, and systems described herein. For example, in some embodiments, previously-drilled wellbores can be connected with newly-drilled production wells by creating paths 117 between wells to provide fluid communication between wells. These advantages can significantly enhance the value of the services provided by an operation/exploration company, helping to reduce time-related costs and increase customer satisfaction.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although specific embodiments have been illustrated and described herein, it will be appreciated by those of ordinary skill in the art that any arrangement that is calculated to achieve the same purpose may be substituted for the specific embodiments shown. Various embodiments use permutations or combinations of embodiments described herein. It is to be understood that the above description is therefore intended to be illustrative, and not restrictive, and that the phraseology or terminology employed herein is for the purpose of description. Combinations of the above embodiments and other embodiments will be apparent to those of ordinary skill in the art upon studying the above description.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. A method for drilling a subsurface well system, the method comprising:

drilling a production well extending from the earth's surface;

drilling a collection well to collect hydrocarbons from a collection region, wherein the collection region is non-contiguous to the production well and wherein the collection well does not physically intersect the production well;

determining a path along a geological formation between the production well and the collection well based on a measured property of the geological formation associated with a fracture in the geological formation, wherein the path is predicted to fracture; and performing a perforation of the geological formation between the production well and the collection well along the path that is predicted to fracture, the perforation providing a fluid communication channel along the path for fluid communication between the production well and the collection well.

2. The method of claim 1, further comprising:

determining the path based on the measured property of the geological formation comprises measurements of formation stresses.

3. The method of claim 1, wherein determining the path includes determining, based on the measured property, a total organic content of the geological formation between the production well and the collection well that is predicted to fracture.

4. The method of claim 1, wherein the path is determined based on a physical position of the production well relative to the collection well.

5. The method of claim 1, wherein providing the fluid communication channel includes generating a fracture between the production well and the collection well.

6. The method of claim 5, further comprising:

monitoring a well property at one of the production well and the collection well to determine whether fluid communication exists between the production well and the collection well.

7. The method of claim 6, further comprising:

determining a point at which the fracturing is to be terminated based on the monitoring.

8. The method of claim 1, wherein providing the fluid communication channel includes perforating the geological formation at a one or more points within the geological formation.

9. The method of claim 8, further comprising:

generating a fracture along a preferential direction based on the measured property to create the fluid communication channel, wherein the preferential direction is further indicated upon performing the perforation.

10. The method of claim 9, wherein the perforating includes adjusting a spread of perforations by aligning perforation guns in a pattern distribution over a circumference of the production well.

11. The method of claim 1, wherein the path is not a shortest distance path between the production well and the collection well.

12. The method of claim 1, wherein the collection well is drilled such that the collection well is communicatively isolated from the production well.

13. A system, comprising:

at least one measurement device to measure at least one property as a measured property associated with a fracture in a geological formation between a production well and a collection well, wherein the collection well extends within a collection region and is non-contiguous to and does not physically intersect the production well;

a processing unit to determine a path along the geological formation between the production well and the collection well based on the measured property, wherein the path is predicted to fracture; and a fracturing device coupled to the processing unit to provide a fluid communication channel within the geological formation, along the path that is predicted to fracture based on the measured property to provide for fluid communication between the production well and the collection well.

14. The system of claim 13, wherein the at least one measurement device includes a device for measuring a spatial relationship between the production well and the collection well.

15. The system of claim 13, wherein the fracturing device includes a fracturing fluid injection valve.

16. The system of claim 15, wherein the fracturing fluid injection valve is coupled to a choke to adjust pressure and flow rate of a fracturing fluid.

17. The system of claim 13, wherein the fracturing device includes a perforation gun.

18. The system of claim 13, further comprising:

a downhole logging tool attached to the at least one measurement device.

19. The system of claim 13, further including at least one sensor to monitor a well property at the collection well to determine whether fluid communication exists between the production well and the collection well, and wherein the processing unit is to determine a point at which the fracturing is to be terminated based on the well property.

20. The system of claim 13, further comprising:

memory to store azimuthal formation evaluation logs, for access by the processing unit to determine the path in the geological formation between the production well and the collection well.

* * * * *